US010604886B2

(12) United States Patent
Bing et al.

(10) Patent No.: US 10,604,886 B2
(45) Date of Patent: Mar. 31, 2020

(54) CONDENSATION-BASED CLOTHES DRYER AND CONDENSATION-BASED CLOTHES DRYING METHOD

(71) Applicant: QINGDAO HAIER WASHING MACHINE CO., LTD., Qingdao, Shandong (CN)

(72) Inventors: Jindong Bing, Qingdao (CN); Haiming Xie, Qingdao (CN); Longping Yao, Qingdao (CN)

(73) Assignee: QINGDAO HAIER WASHING MACHINE CO., LTD., Qingdao, Shandong (CN)

( * ) Notice: Subject to any disclaimer, the term of this patent is extended or adjusted under 35 U.S.C. 154(b) by 121 days.

(21) Appl. No.: 15/570,169

(22) PCT Filed: Apr. 29, 2016

(86) PCT No.: PCT/CN2016/080658
§ 371 (c)(1),
(2) Date: Oct. 27, 2017

(87) PCT Pub. No.: WO2016/173534
PCT Pub. Date: Nov. 3, 2016

(65) Prior Publication Data

US 2018/0135234 A1 May 17, 2018

(30) Foreign Application Priority Data

Apr. 29, 2015 (CN) ..... 2015 1 0212800

(51) Int. Cl.
*F26B 13/18* (2006.01)
*D06F 58/24* (2006.01)
(Continued)

(52) U.S. Cl.
CPC ..... *D06F 58/24* (2013.01); *D06F 58/28* (2013.01); *D06F 58/02* (2013.01); *D06F 58/20* (2013.01); *D06F 2058/2864* (2013.01)

(58) Field of Classification Search
CPC ..... F01N 2560/028; F26B 13/183; F26B 21/086; F26B 25/06
See application file for complete search history.

(56) References Cited

U.S. PATENT DOCUMENTS 5,117,563 A 6/1992 Castonguay
5,361,511 A * 11/1994 Brown ..... D06F 58/206 34/468
(Continued)

FOREIGN PATENT DOCUMENTS

CN 101259362 9/2008
CN 103392035 11/2013
(Continued)

OTHER PUBLICATIONS

International Patent Application No. PCT/CN2016/080658, International Search Report, dated Jun. 28, 2016.
(Continued)

*Primary Examiner* — Gregory A Wilson
(74) *Attorney, Agent, or Firm* — Greenberg Traurig

(57) ABSTRACT

A condensation-based clothes dryer includes a box body, a drum, a front hot air duct, a rear hot air duct, an air chamber, a fan, a motor, a heater, a master control board and a condenser; where the rear hot air duct, the drum, the front hot air duct and the air chamber are communicated, an inlet end of a condensation air duct of the condenser is communicated with an air outlet in the box body, and an outlet end of the condensation air duct is communicated with outside air, an inlet end of a cooling air duct of the condenser is communicated with outside air, and an outlet end of the cooling air duct is communicated with an air inlet in the box
(Continued)

body, and a condensate water collecting box is arranged below the condenser.

8 Claims, 4 Drawing Sheets

(51) Int. Cl.

| | |
|---|---|
| ***D06F 58/28*** | (2006.01) |
| *D06F 58/02* | (2006.01) |
| *D06F 58/20* | (2006.01) |

(56) References Cited

U.S. PATENT DOCUMENTS

| | | | | |
|---|---|---|---|---|
| 8,544,187 | B2 * | 10/2013 | Choi | D06F 58/28 34/407 |
| 8,590,172 | B2 * | 11/2013 | Ahn | D06F 58/206 34/595 |
| 2008/0110041 | A1 | 5/2008 | Ehlers | |
| 2008/0216341 | A1 * | 9/2008 | Mukaiyama | D06F 58/206 34/124 |
| 2014/0109426 | A1 * | 4/2014 | Ahn | D06F 58/206 34/73 |
| 2014/0345152 | A1 * | 11/2014 | Ben-Shmuel | D06F 58/266 34/255 |
| 2014/0366397 | A1 * | 12/2014 | Wakizaka | D06F 58/206 34/524 |
| 2016/0138209 | A1 * | 5/2016 | Kitayama | D06F 58/24 34/499 |
| 2016/0160428 | A1 * | 6/2016 | Lee | D06F 58/206 34/427 |

FOREIGN PATENT DOCUMENTS

| | | | |
|---|---|---|---|
| CN | 104420144 | | 3/2015 |
| DE | 2923701 | * | 6/1979 |
| EP | 163265 | | 12/1985 |
| EP | 0366642 | | 5/1990 |
| EP | 1291597 | | 3/2003 |
| GB | 2092729 | | 8/1982 |
| JP | 51-21181 | | 8/1974 |
| JP | 56-14594 | | 7/1979 |
| JP | 63-132698 | | 8/1988 |
| JP | 2006026407 | | 2/2006 |
| JP | 2011072589 | | 4/2011 |
| JP | 2012029783 | | 2/2012 |
| JP | 2013102860 | | 5/2013 |
| JP | 2014046133 | | 3/2014 |
| JP | 2015016184 | | 1/2015 |
| JP | 2015024116 | | 2/2015 |
| JP | 2015073606 | | 4/2015 |
| KR | 20080082496 | | 9/2008 |

OTHER PUBLICATIONS

Extended European Search Report, European Patent Application 16785962.8, dated Nov. 30, 2018.

* cited by examiner

--Prior Art--

--Prior Art--

CONDENSATION-BASED CLOTHES DRYER AND CONDENSATION-BASED CLOTHES DRYING METHOD

The present application is a national phase application under 35 U.S.C. § 371 of International Patent Application PCT/CN2016/080658, filed on Apr. 29, 2016, entitled "Condensation-Based Clothes Dryer and Condensation-Based Clothes Drying Method", which claims priority to Chinese Patent Application No. 201510212800.4, filed on Apr. 29, 2015, the entire disclosures of which applications are hereby incorporated herein by reference.

TECHNICAL FIELD

The present disclosure relates to the technical field of clothes dryers, and particularly relates to a condensation-based clothes dryer and a condensation-based clothes drying method applied to the condensation-based clothes dryer.

BACKGROUND

At present, clothes dryers in a market include a directly-drained clothes dryer, an ordinary air condensation-based clothes dryer, a heat pump clothes dryer and the like. As shown in FIG. 1, an existing directly-drained clothes dryer is mainly composed of a box body 1', a drum 2', a front hot air duct 3', a rear hot air duct 4', an air chamber 5', a fan 6' and a motor arranged in the air chamber 5', and a heater 7' arranged in the rear air duct, wherein the front hot air duct 3' is communicated with a front of the drum 2' and the air chamber 5'; the rear hot air duct 4' is communicated with a back of the drum 2' and the air chamber 5' to form a circulating passage; and the motor simultaneously drives the fan 6' for pumping and draining the air and the drum 2' for shaking out clothes to rotate. A clothes drying method of the directly-drained clothes dryer is as follows: Air enters the heater 7' from outside through an air inlet hole, is heated to become hot air and enters the drum 2' through the rear hot air duct 4' to heat clothes in the drum 2', so that water in clothes is evaporated to achieve a purpose of drying clothes. Damp air with the water is exhausted to the outside by an exhaust pipe through the front hot air duct 3' and the air chamber 5' under drive of the fan 6'. The directly-drained clothes dryer has a disadvantage that an exhaust pipeline needs to be connected to exhaust damp and hot air to the outside, which is inconvenient in installation and impossible for saving energy.

As shown in FIG. 2, an existing condensation-based clothes dryer is improved on the basis of the structure of the above directly-drained clothes dryer. A condenser 8' is mainly added in the air chamber 5'; the condenser 8' has a condensation air duct and a cooling air duct; the condensation air duct is connected with the front hot air duct 3' and the air chamber 5'; one end of the cooling air duct is connected with the exhaust fan 9' through a rear cold air duct; an inlet of the exhaust fan 9' is communicated with an air inlet arranged in the box body 1'; the other end of the cooling air duct is communicated with an air outlet in the box body 1'; and a condensate water collecting box 10' is arranged at an outlet of the condensation air duct. Since the damp and hot air including massive vapor from the drum 2' enters the condenser 8' through the front hot air duct 3', moisture in the hot air is condensed into water; meanwhile, heat is transferred to the condenser 8'; and condensate water flows into the condensate water collecting box 10'. The condenser 8' with a rising temperature is cooled by the air inlet in the box body 1' through cold air that enters the cooling air duct of the condenser 8' through the rear cooling air duct and the exhaust fan 9', to take away heat stored in the condenser 8', so that the condenser 8' keeps low operation temperature. The moisture in the damp and hot air is condensed so that the damp and hot air becomes dry and hot air; and the rear hot air duct 4' and the heater 7' heat and dry clothes that enter the drum 2' to recycle. Cooling air is exhausted through the air outlet. Although the condensation-based clothes dryer does not need to connect the exhaust pipeline, the damp and hot air can be condensed, thereby realizing convenient installation and effectively reducing heat energy loss. However, selling price is high, drying duration is long and drying speed is low.

Based on above description, a new condensation-based clothes dryer is urgently needed, so as to solve problems of connection with the exhaust pipeline, inconvenient installation and impossibility of energy saving in the existing directly-drained clothes dryer, and low drying speed in the existing condensation-based clothes dryer and the like.

SUMMARY

One purpose of the present disclosure is to propose a condensation-based clothes dryer. The condensation-based clothes dryer is simple in structure and convenient in installation, can exhaust moisture of damp and hot air and save energy, and can also reduce cost, shorten drying duration and enhance drying speed.

Another purpose of the present disclosure is to propose a condensation-based clothes drying method. The condensation-based clothes drying method can effectively remove the moisture of damp and hot air and save energy, and can also reduce cost, shorten drying duration and enhance drying speed.

To achieve the purposes, the present disclosure adopts the following technical solution:

The present disclosure provides a condensation-based clothes dryer, including a box body, a drum, a front hot air duct, a rear hot air duct, an air chamber, a fan for driving air from an inlet to an outlet through an air duct, a motor, a heater for heating air, and a master control board, where the rear hot air duct, the drum, the front hot air duct and the air chamber are communicated to form a circulating air duct; and further including a condenser arranged outside the box body, where the condenser has a condensation air duct and a cooling air duct, an inlet end of the condensation air duct is communicated with an air outlet in the box body, an outlet end of the condensation air duct is communicated with outside air, an inlet end of the cooling air duct is communicated with outside air, an outlet end of the cooling air duct is communicated with an air inlet in the box body, and a condensate water collecting box is arranged below the condenser.

As a solution of the above condensation-based clothes dryer, the fan is arranged in the air chamber, the heater is arranged in the rear hot air duct; and, the air inlet in the box body, the rear hot air duct, the drum, the front hot air duct, the air chamber and the air outlet in the box body are successively communicated.

As a solution of the above condensation-based clothes dryer, the fan is arranged in the rear hot air duct, the heater is arranged in the air chamber; and, the air inlet in the box body, the air chamber, the front hot air duct, the drum, the rear hot air duct and the air outlet in the box body are successively communicated.

As a solution of the above condensation-based clothes dryer, the condenser is made of superconductive material.

As a solution of the above condensation-based clothes dryer, manufacturing material of the condenser is aluminum, copper or plastic.

As a solution of the above condensation-based clothes dryer, the condenser has a multilayer sheet structure.

As a solution of the above condensation-based clothes dryer, a humidity detection apparatus and a temperature detection apparatus are installed in the box body.

The present disclosure further provides a condensation-based clothes drying method applied to the above condensation-based clothes dryer. Outside air enters a box body through a cooling air duct of a condenser and an air inlet in the box body and becomes damp and hot air after heated by the heater; the damp and hot air enters a condensation air duct of the condenser under drive of the fan after heating clothes in a drum, and performs heat exchange with outside air that enters the box body through the cooling air duct of the condenser; moisture in the damp and hot air is condensed into water, so that the damp and hot air becomes dry and hot air and is exhausted; and outside air enters the box body after absorbing heat to dry clothes according to the above circulation mode.

The present disclosure has beneficial effects as follows:

The present disclosure provides a condensation-based clothes dryer. The condensation-based clothes dryer is simple in structure and convenient in installation, and can exhaust the discharged damp and hot air after lowering temperature and removing dampness through the condenser. Meanwhile, the condenser absorbs the discharged heat. When the dry and cold air passes through the condenser and brings the heat into the clothes dryer, the clothes dryer can effectively exhaust moisture of the damp and hot air, and save energy, and realize low cost, short drying duration and high drying speed.

The present disclosure further provides a condensation-based clothes drying method. The condensation-based clothes drying method is applied to the above condensation-based clothes dryer, thereby effectively realizing removal of the moisture of the damp and hot air, saving energy, greatly reducing cost, shortening drying duration and increasing drying speed.

BRIEF DESCRIPTION OF DRAWINGS

To describe technical solutions in embodiments of the present disclosure more clearly, drawings to be used in describing embodiments of the present disclosure will be described briefly below. Apparently, the drawings described below are only some embodiments of the present disclosure. For those ordinary skilled in the art, other drawings can also be obtained according to contents of embodiments of the present disclosure and these drawings without contributing creative labor.

In the figures.

1': Box body; 2': Drum; 3': Front hot air duct; 4': Rear hot air duct; 5': Air chamber; 6': Fan; 7': Heater; 8': Condenser; 9': Exhaust fan; 10': Condensate water collecting box;

1: Box body; 2: Drum; 3: Front hot air duct; 4: Rear hot air duct; 5: Air chamber; 6: Fan; 7: Heater; 8: Condenser; 9: Condensate water collecting box-; 10: Condensation air duct; 11: Cooling air duct.

DETAILED DESCRIPTION

To make technical problems solved by the present disclosure, technical solutions adopted by the present disclosure, and achieved technical effects more clear, the technical solutions in embodiments of the present disclosure will be further described in detail below in combination with drawings. Apparently, described embodiments are merely some embodiments of the present disclosure, not all of the embodiments. All other embodiments obtained by those skilled in the art without contributing creative labor based on embodiments in the present disclosure belong to a protection scope of the present disclosure.

Embodiment I

Figure 1:
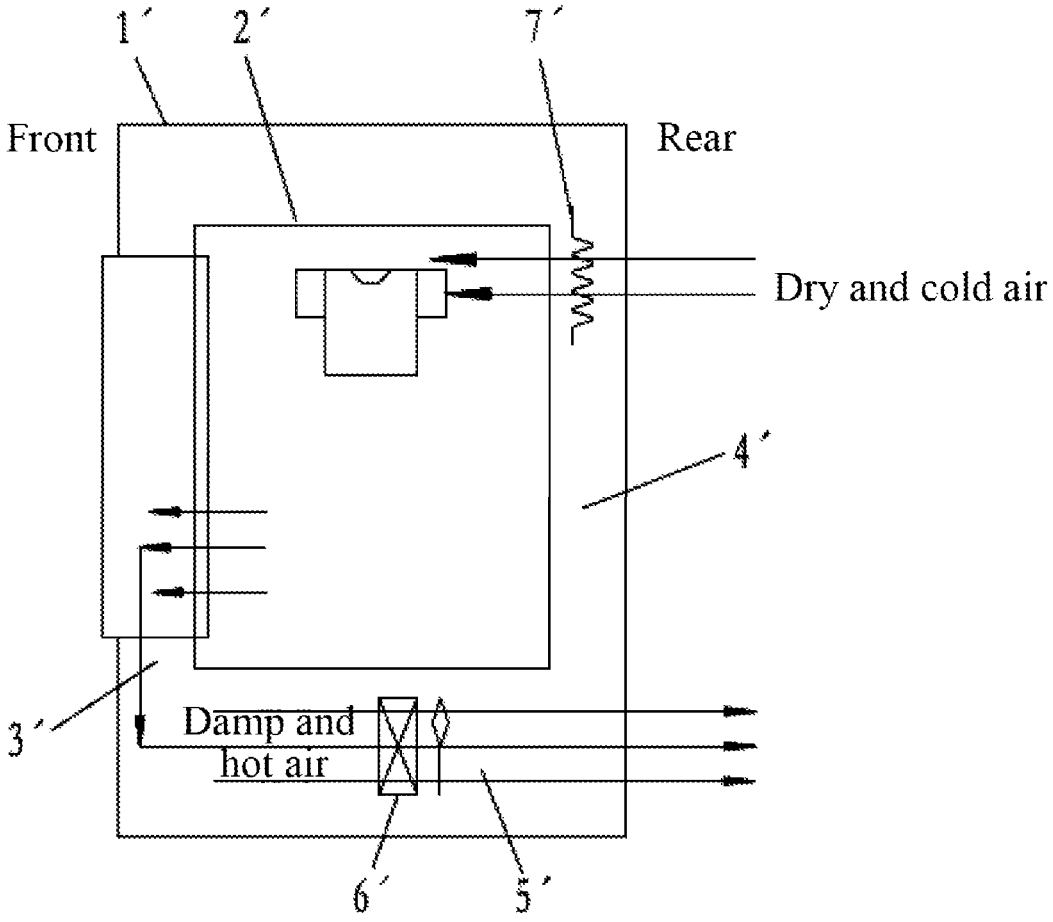
FIG. 1 is a schematic structural diagram illustrating an existing directly-drained clothes dryer.
Figure 2:
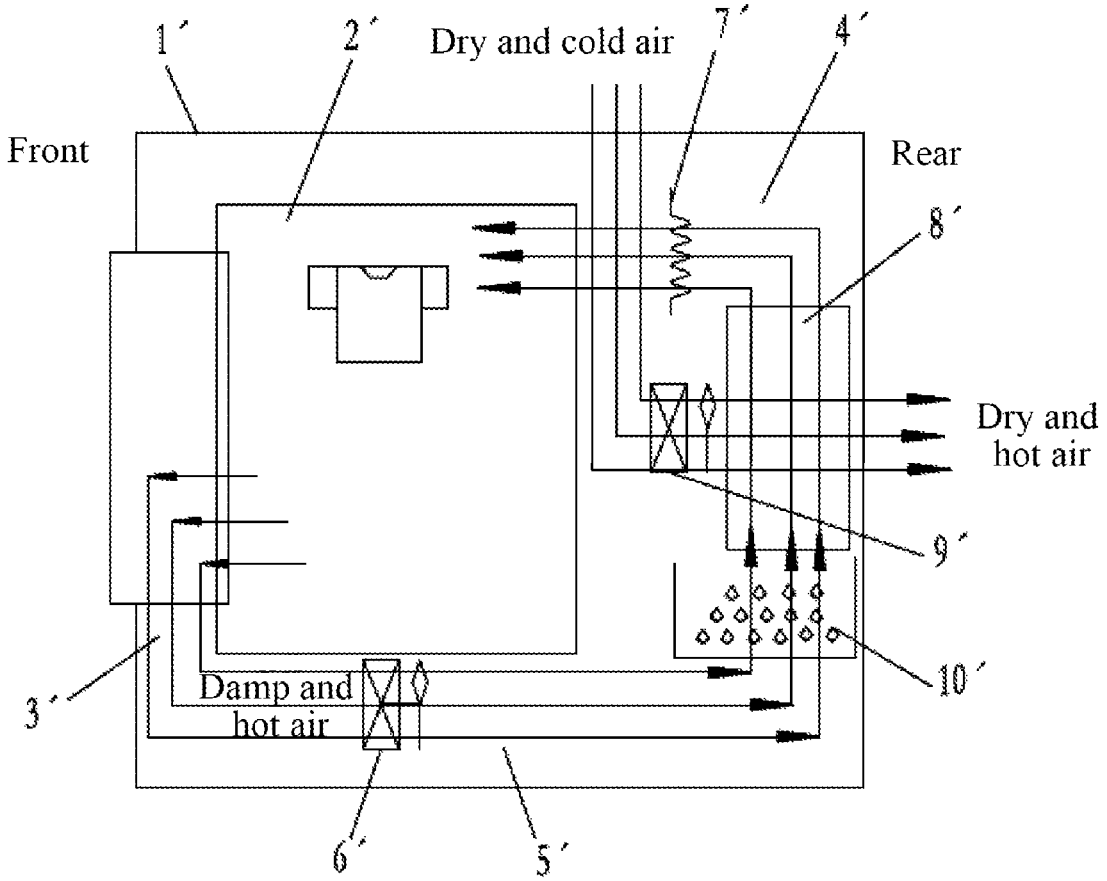
FIG. 2 is a schematic structural diagram illustrating an existing condensation-based clothes dryer.
Figure 3:
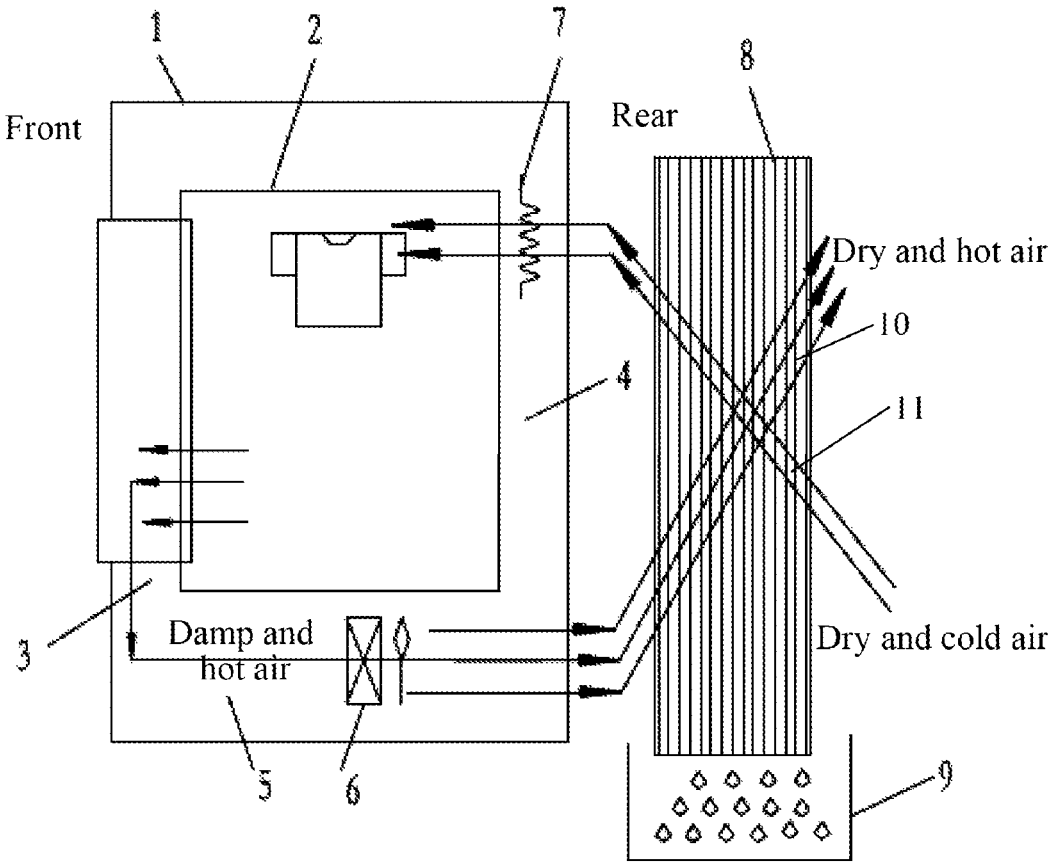
FIG. 3 is a schematic structural diagram illustrating a condensation-based clothes dryer provided in embodiment I of the present disclosure.

With respect to problems of need of connection with an exhaust pipeline, inconvenient installation and incapability in energy saving in an existing directly-drained clothes dryer, and problems of low drying speed and the like in an existing condensation-based clothes dryer, a new condensation-based clothes dryer is proposed. As shown in FIG. 3, a condensation-based clothes dryer provided in the present embodiment includes a box body 1, a drum 2, a front hot air duct 3, a rear hot air duct 4, an air chamber 5, a fan 6 (or air blower) for driving air from an inlet to an outlet through an air duct, a motor, a heater 7 for heating air, a master control board and a condenser 8 arranged outside the box body 1. The rear hot air duct 4, the drum 2, the front hot air duct 3 and the air chamber 5 are communicated to form a circulating air duct. The condenser 8 has a condensation air duct 10 and a cooling air duct 11. An inlet end of the condensation air duct 10 is communicated with an air outlet in the box body 1, and an outlet end of the condensation air duct 10 is communicated with outside air. An inlet end of the cooling air duct 11 is communicated with outside air, and an outlet end of the cooling air duct 11 is communicated with an air inlet in the box body 1. A condensate water collecting box 9 is arranged below the condenser 8.

In the present embodiment, as a solution of the above condensation-based clothes dryer, the fan 6 is arranged in the air chamber 5; the heater 7 is arranged in the rear hot air duct 4; and, the air inlet in the box body 1, the rear hot air duct 4, the drum 2, the front hot air duct 3, the air chamber 5 and the air outlet in the box body 1 are successively communicated to form a circulating air duct.

The present embodiment further proposes a condensation-based clothes drying method applied to the above condensation-based clothes dryer. The motor drives the fan and the drum 2 arranged in the air chamber 5 to rotate, so that outside air enters the hot air duct 4 of the box body 1 through the cooling air duct 11 of the condenser 8 and the air inlet in the box body 1, and becomes damp and hot air after heated by the heater 7; the damp and hot air enters the condensation air duct 10 of the condenser 8 through the front hot air duct 3 after heating clothes in the drum 2, and performs heat exchange with outside air that enters the box body 1 through the cooling air duct 11 of the condenser 8; moisture in the damp and hot air is condensed into water; the damp and hot air becomes dry and hot air and is exhausted; and outside air enters the box body 1 after absorbing heat to dry clothes according to the above circulation mode.

To remove massive vapor included in the damp and hot air exhausted by the drum 2, the discharged damp and hot air can be exhausted after lowering temperature and removing dampness, thereby omitting a project of installing an exhaust pipeline in an existing directly-drained clothes dryer. The condenser 8 is additionally arranged outside the box body 1, and the damp and hot air including massive vapor is cooled by using the condenser 8, so that moisture in the damp and hot air is condensed into water and the damp and hot air becomes dry and hot air and is exhausted; and the dry and cold air at the air inlet enters the clothes dryer after absorbing heat through the condenser 8 to dry clothes, thereby not only saving energy and reducing cost, but also shortening drying duration and increasing drying speed.

In the present embodiment, as a solution of the above condensation-based clothes dryer, to increase heat conduction efficiency, the condenser 8 is made of hot superconductive material such as aluminum or copper or plastic and the like so as to form a multilayer sheet structure.

As a solution of the above condensation-based clothes dryer, a temperature detection apparatus is installed in the box body 1. When the temperature detection apparatus detects that the temperature of the box body 1 is higher than a set temperature, the heater 7 stops operating and the rest systems continue to operate, so that the temperature in the box body 1 is not too high and clothes would not be damaged.

As a solution of the above condensation-based clothes dryer, a humidity detection apparatus is further installed in the box body 1. When the humidity detection apparatus detects that the humidity is lower than a set value before preset duration of a drying procedure is ended, the clothes dryer stops operating, thereby realizing stop of clothes drying when clothes are dried so as to save energy consumption. When the humidity detection apparatus detects that the humidity is higher than a set value after the preset duration of the drying procedure is ended, the clothes dryer prolongs a period of drying duration until humidity achieves the set value.

Embodiment II

Figure 4:
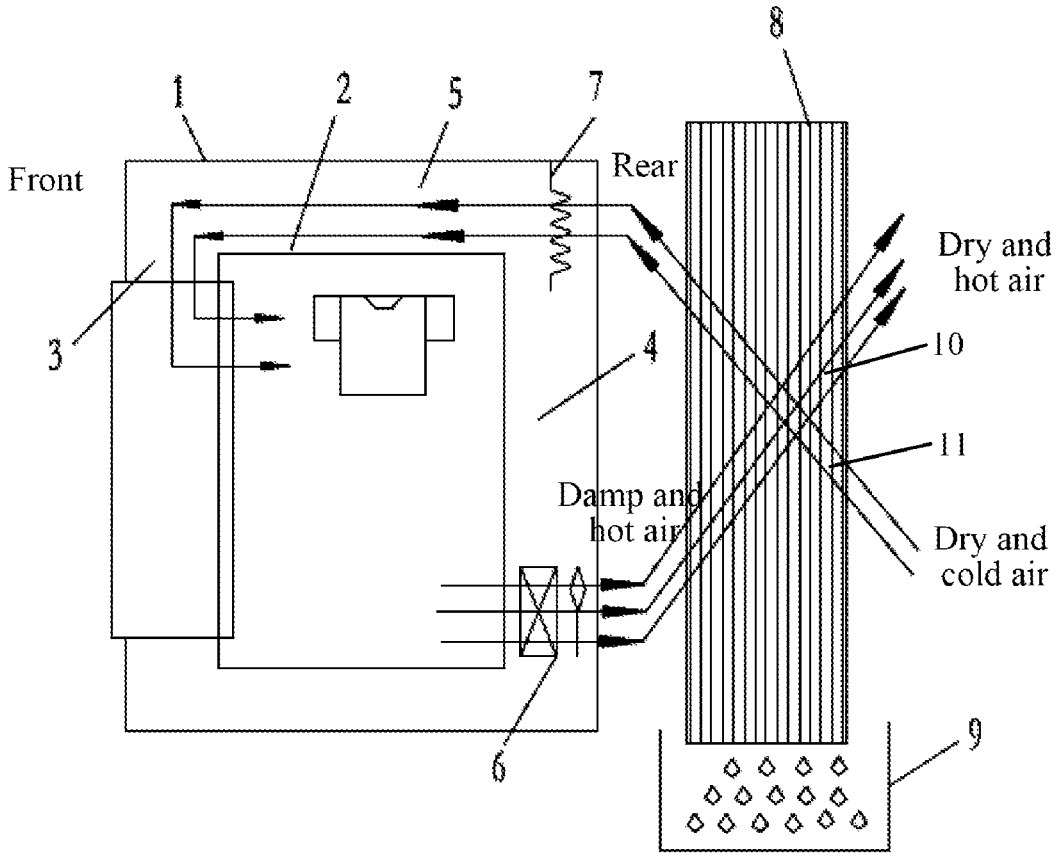
FIG. 4 is a schematic structural diagram illustrating a condensation-based clothes dryer provided in embodiment II of the present disclosure.

The present embodiment provides another new condensation-based clothes dryer. As shown in FIG. 4, a structure of the condensation-based clothes dryer described in the present embodiment is different from a structure of the condensation-based clothes dryer described in embodiment I in that: in the present embodiment, the fan 6 is arranged in the rear hot air duct 4; the heater 7 is arranged in the air chamber 5; and, the air inlet in the box body 1, the air chamber 5, the front hot air duct 3, the drum 2, the rear hot air duct 4 and the air outlet in the box body 1 are successively communicated so as to form a circulating air duct. Namely, a circulation order of air in the box body 1 in the present embodiment is as follows: the air inlet in the box body 1—the air chamber 5—the front hot air duct 3—the drum 2—the rear hot air duct 4—the air outlet in the box body 1. The condensation-based clothes drying method is similar to the condensation-based clothes drying method described in embodiment I, and is not repeated herein. A linkage form of the circulating air duct in the box body of the condensation-based clothes dryer in the present application is not limited to the above condition but can be randomly designed as long as clothes in the drum can be dried through the circulation of air.

Compared with an existing condensation-based clothes dryer, the present application adopts only one fan (or air blower) to realize air circulation and drive heat transmission. Therefore, the cost of the present application is lower.

The condenser in the present application may be an individual module. When the condenser is taken away, what has left is a directly-drained clothes dryer; and when the condenser is installed, discharge of moisture can be reduced. Exhausted heat is used for saving energy, so as to form an open condensation-based clothes dryer. An air blower is added on the condenser to close the system to form a complete condensation-based clothes dryer. Therefore, the present application has an advantage of multiple purposes by one apparatus, and can greatly increase product competitiveness.

It shall be noted that the above contents are only embodiments of the present disclosure and used technical principles. It can be understood for those skilled in the art that the present disclosure is not limited to specific embodiments described herein. For those skilled in the art, the present disclosure can be subject to various apparent variations, readjustments and replacements without departing from a protection scope of the present disclosure. Therefore, although the present disclosure is described in detail through above embodiments, the present disclosure is not only limited to above embodiments. The present disclosure can also include more other equivalent embodiments without deviating from conceptions of the present disclosure. A scope of the present disclosure is determined by a scope of attached claims.

What is claimed is:

1. A condensation-based clothes dryer, comprising a box body, a drum, a front hot air duct, a rear hot air duct, an air chamber, a fan for driving air from an air inlet in the box body to an air outlet in the box body through a circulating air duct, and a heater for heating air, wherein the rear hot air duct, the drum, the front hot air duct and the air chamber are communicated to form the circulating air duct; and further comprising a condenser arranged outside the box body, wherein the condenser has a multilayer sheet structure, the condenser has a condensation air duct and a cooling air duct, an inlet end of the condensation air duct is communicated with the air outlet in the box body, an outlet end of the condensation air duct is communicated with outside air, an inlet end of the cooling air duct is communicated with outside air, an outlet end of the cooling air duct is communicated with the air inlet in the box body, and a condensate water collecting box is arranged below the condenser.

2. The condensation-based clothes dryer according to claim 1, wherein the fan is arranged in the air chamber, the heater is arranged in the rear hot air duct; and, the air inlet in the box body, the rear hot air duct, the drum, the front hot air duct, the air chamber and the air outlet in the box body are successively communicated.

3. The condensation-based clothes dryer according to claim 2, wherein the condenser is made of superconductive material.

4. The condensation-based clothes dryer according to claim 1, wherein the fan is arranged in the rear hot air duct, the heater is arranged in the air chamber; and, the air inlet in the box body, the air chamber, the front hot air duct, the drum, the rear hot air duct and the air outlet in the box body are successively communicated.

5. The condensation-based clothes dryer according to claim 4, wherein the condenser is made of superconductive material.

6. The condensation-based clothes dryer according to claim 1, wherein the condenser is made of superconductive material.

7. The condensation-based clothes dryer according to claim 1, wherein manufacturing material of the condenser is aluminum, copper or plastic.

8. A condensation-based clothes drying method, comprising: causing outside air to enter a box body through a cooling air duct of a condenser having a multilayer sheet structure and an air inlet in the box body and obtaining damp and hot air after the air entering the box is heated by a heater; causing the damp and hot air to enter a condensation air duct of the condenser under drive of a fan after the damp and hot air heats clothes in a drum, and performing heat exchange between the damp and hot air and the outside air that enters the box body through the cooling air duct of the condenser; condensing moisture in the damp and hot air into water, so that the damp and hot air becomes dry and hot air and the dry and hot air is exhausted; and causing outside air after absorbing heat to enter the box body to dry clothes.

* * * * *